US009559446B1

(12) United States Patent
Wetzel et al.

(10) Patent No.: US 9,559,446 B1
(45) Date of Patent: Jan. 31, 2017

(54) ELECTRICAL CONNECTOR HAVING A SIGNAL CONTACT SECTION AND A POWER CONTACT SECTION

(71) Applicant: TYCO ELECTRONICS CORPORATION, Berwyn, PA (US)

(72) Inventors: John Joseph Wetzel, Menlo Park, CA (US); Brian Patrick Costello, Scotts Valley, CA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/993,801

(22) Filed: Jan. 12, 2016

(51) Int. Cl.
*H01R 13/648* (2006.01)
*H01R 12/70* (2011.01)
*H01R 13/6585* (2011.01)

(52) U.S. Cl.
CPC ..... *H01R 12/7076* (2013.01); *H01R 13/6585* (2013.01)

(58) Field of Classification Search
CPC ..... H01R 14/6594
USPC ..... 439/607.05–607.11, 108
See application file for complete search history.

(56) References Cited

U.S. PATENT DOCUMENTS 3,923,362 A * 12/1975 Dunn ..... H01R 4/2433 439/200
5,059,130 A * 10/1991 Miller, Jr. ..... H01R 12/523 439/74
5,357,057 A * 10/1994 Debbaut ..... H01B 17/60 174/76
7,168,988 B1 * 1/2007 Rothermel ..... H01R 13/6625 439/108
7,704,081 B2 * 4/2010 Swanger ..... H01R 13/6585 439/607.07
8,079,847 B2 * 12/2011 Davis ..... H01R 12/7088 439/607.11
8,911,255 B2 * 12/2014 Scherer ..... H01R 13/6463 439/607.07

* cited by examiner

*Primary Examiner* — Phuong Dinh

(57) ABSTRACT

An electrical connector includes a housing having a signal contact section and a power contact section. The housing has a plurality of signal contact channels at the signal contact section and a plurality of power contact channels at the power contact section. A signal contact assembly is coupled to a rear of the housing and has a plurality of signal contacts. The signal contacts are configured to be terminated to a circuit board. A power contact assembly is coupled to the rear of the housing and has a plurality of power contacts received in corresponding power contact channels. The power contacts are terminated to ends of power wires. The power wires are configured to be electrically connected to the circuit board remote from the signal contacts.

18 Claims, 6 Drawing Sheets

ELECTRICAL CONNECTOR HAVING A SIGNAL CONTACT SECTION AND A POWER CONTACT SECTION

BACKGROUND OF THE INVENTION

The subject matter herein relates generally to electrical connectors that provide an interconnection between circuit boards.

Electrical systems, such as those used in networking and telecommunication systems, utilize connectors to interconnect electrical components and route power through the system. The electrical connectors are mounted to circuit boards, such as motherboards, daughtercards, backplanes, line cards, switch cards and the like. In conventional systems, line and switch cards are connected to backplanes using midplane circuit boards. The midplane circuit boards include header connectors on both sides of the midplane circuit board, such header connectors being mated to receptacle connectors on the daughter cards that plug into the midplane. Midplanes add cost and additional electrical routing complexity to systems. Some known systems eliminate the need for the midplane circuit boards by using direct plugging of electrical connectors on the daughter cards on one side of the system to the daughter cards on the other side of the system. The daughter cards on opposite sides of the system are typically orthogonal to each other (for example, the daughter cards on the front side are horizontal while the daughter cards on the rear side are vertical, or vice versa), which makes connector design difficult.

Furthermore, system demands are increasing. For example, some systems require power connectors to transmit power between the circuit boards. However, due to the arrangement of the circuit boards in orthogonal orientations, placement of the connectors, and transmission of power, is difficult. For example, separate power connectors are provided and mating of such power connectors is difficult due to the relative orientations of the circuit boards. Further, the routing of power on a circuit board can be difficult. Significant space must be reserved for power to be routed through power connectors to various components located in the system.

A need remains for an electrical connector system that provides power and data signal transmission between orthogonal circuit boards; and can reduce the space requirements needed for routing power on a circuit board.

BRIEF DESCRIPTION OF THE INVENTION

In one embodiment, an electrical connector is provided including a housing having a front configured to mate with a mating electrical connector and a rear opposite the front. The housing has a signal contact section and a power contact section. The housing has a plurality of signal contact channels extending therethrough at the signal contact section. The housing has a plurality of power contact channels extending therethrough at the power contact section. A signal contact assembly is coupled to the rear of the housing. The signal contact assembly has a plurality of signal contacts aligned with corresponding signal contact channels and configured for mating with the mating electrical connector. The signal contacts are configured to be terminated to a circuit board. A power contact assembly is coupled to the rear of the housing. The power contact assembly has a plurality of power contacts received in corresponding power contact channels and configured for electrical connection with the mating electrical connector. The power contacts are terminated to ends of power wires. The power wires are configured to be electrically connected to the circuit board remote from the signal contacts.

In another embodiment, an electrical connector is provided including a housing having a front configured to mate with a mating electrical connector and a rear opposite the front. The housing has a signal contact section and a power contact section. The housing has a plurality of signal contact channels extending therethrough at the signal contact section and a plurality of power contact channels extending therethrough at the power contact section. A signal contact assembly is coupled to the rear of the housing. The signal contact assembly has a plurality of signal contact modules in a stacked arrangement. Each signal contact module has a dielectric frame holding a plurality of signal contacts. The dielectric frame is coupled to the rear of the housing such that the signal contacts are aligned with corresponding signal contact channels and configured for mating with the mating electrical connector. The signal contacts extend from the dielectric frame and are configured to be terminated to a circuit board. A power contact assembly having a power contact module is coupled to the rear of the housing. The power contact module has a dielectric frame holding a plurality of power contacts. The dielectric frame is coupled to the rear of the housing such that the power contacts extend into the housing and are received in corresponding power contact channels for electrical connection with the mating electrical connector. The power contacts extend from the dielectric frame and are configured to be terminated to the circuit board.

In a further embodiment, an electrical connector system is provided including a receptacle connector terminated to a first circuit board and a header connector terminated to a second circuit board. The receptacle and header connectors are directly plugged together with the first and second circuit boards being orthogonal to each other. The receptacle connector includes a receptacle housing having a signal contact section and a power contact section with signal contact channels and power contact channels extending therethrough at the signal and power contact sections, respectively. A receptacle signal contact assembly is coupled to the rear of the receptacle housing with receptacle signal contacts aligned with corresponding signal contact channels. A receptacle power contact assembly is coupled to the rear of the receptacle housing with receptacle power contacts received in corresponding power contact channels. The header connector includes a header housing having a signal contact section and a power contact section with signal contact channels and power contact channels extending therethrough at the signal and power contact sections, respectively. A header signal contact assembly is coupled to the rear of the header housing with header signal contacts aligned with corresponding signal contact channels and a header power contact assembly being coupled to the rear of the header housing with header power contacts received in corresponding power contact channels. The header signal contacts are mated with corresponding receptacle signal contacts and the header power contacts being mated with corresponding receptacle power contacts.

DETAILED DESCRIPTION OF THE INVENTION

Figure 1:
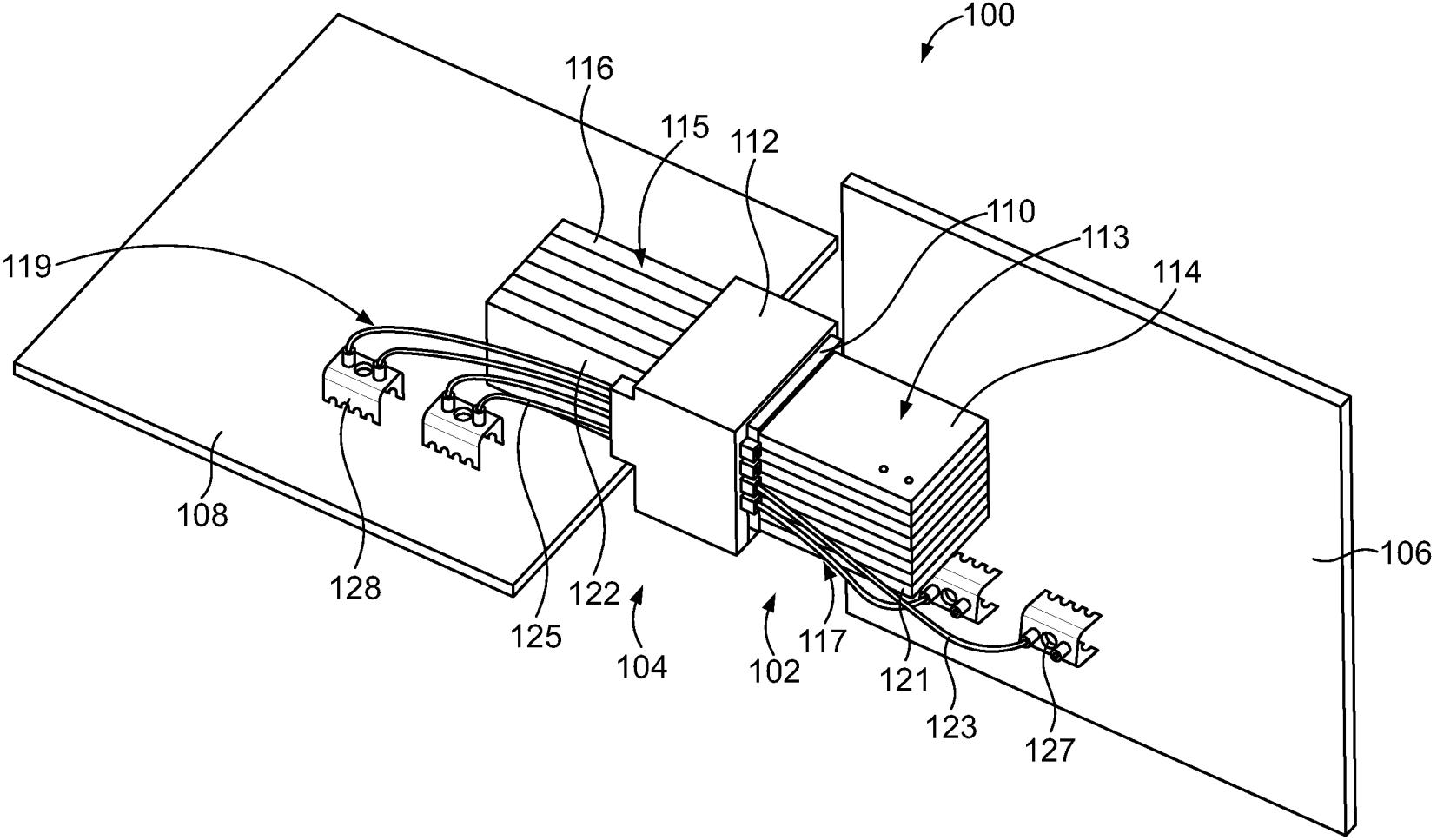
FIG. 1 is a perspective view of an exemplary embodiment of an electrical connector system formed in accordance with an exemplary embodiment showing receptacle and header connectors directly mated together in an orthogonal orientation.

FIG. 1 is a perspective view of an exemplary embodiment of an electrical connector system 100, illustrating electrical connectors 102 and 104 that may be directly mated together. In the illustrated embodiment, the first electrical connector 102 is a receptacle connector, and may be referred to hereinafter as a receptacle connector 102. In the illustrated embodiment, the second electrical connector 104 is a header connector 104 and may be referred to hereinafter as a header connector 104. The electrical connectors 102, 104 may be any type of connectors in alternative embodiments. The electrical connectors 102, 104 may be referred to individually as electrical connector or mating electrical connector and may be referred to collectively as electrical connectors or mating electrical connectors.

The receptacle and header connectors 102, 104 are each electrically connected to respective circuit boards 106, 108. In an exemplary embodiment, the receptacle and header connectors 102, 104 integrate power connectors that distribute power, in addition to signals. The receptacle and header connectors 102, 104 have dedicated power transmission lines, rather than overlaying power on the signal lines allowing the electrical connectors 102, 104 to convey higher voltage power. For example, receptacle and header connectors 102, 104 may distribute 48V, or more. Additionally, dedicated power transmission line may allow higher current power. For example, signal lines in receptacle and header connectors 102, 104 may be limited to 0.5 amp per line current capacity while dedicated power transmission lines may carry several amps per line.

The receptacle and header connectors 102, 104 are utilized to electrically connect the circuit boards 106, 108 to one another at a separable mating interface. The receptacle and header connectors 102, 104 allow the circuit boards 106, 108 to be electrically connected across a single directly connected interface and do not require a mid-plane circuit board and corresponding connector interfaces between the circuit boards 106, 108. In an exemplary embodiment, the circuit boards 106, 108 are oriented orthogonal to one another when the receptacle and header connectors 102, 104 are mated. For example, the first circuit board 106 is oriented vertically while the second circuit board 108 is oriented horizontally. As such, the electrical connector system 100 defines a direct plug orthogonal connector architecture where the connectors of orthogonal circuit boards are directly plugged together. Alternative orientations of the circuit boards 106, 108 are possible in alternative embodiments. In other alternative embodiments, either or both of the connectors 102, 104 may be cable connectors terminated to ends of cables rather than being board connectors terminated to the circuit boards 106, 108.

The receptacle and header connectors 102, 104 include receptacle and header housings 110 and 112, respectively. The housings 110, 112 each hold a signal contact assembly 113, 115, respectively, and a power contact assembly 117, 119, respectively, which transmit data signals and power, respectively. As such, the signal contact assemblies 113, 115 and the power contact assemblies 117, 119 are both integrated into common housings 110, 112 to create an integrated, single mating interface for both power and high speed signals for the direct plug orthogonal connector architecture. The integrated connectors 102, 104 provide a low profile design for direct plug orthogonal space restrictions. The connectors 102, 104 provide a single mating action for the operator. The connectors 102, 104 eliminate the need for independent power and high-speed signal connectors and two step mating operations.

In an exemplary embodiment, the receptacle signal contact assembly 113 includes a plurality of receptacle signal contact modules 114 defining signal lines between the circuit boards 106, 108. The header signal contact assembly 115 includes a plurality of header signal contact modules 116 defining signal lines between the circuit boards 106, 108. Any number of signal contact modules 114, 116 may be provided in each housing 110, 112 and the signal contact modules 114, 116 are provided in adjoining arrangements. The signal contact modules 114 in the receptacle connector 102 may be identical to one another, and the signal contact modules 116 in the header connector 104 may be identical to one another. In the illustrated embodiment, the receptacle and header connectors 102, 104 are oriented such that the receptacle signal contact modules 114 are orthogonal to the header signal contact modules 116. As such, each receptacle signal contact module 114 is configured to be mated with adjacent header signal contact modules 116. For example, the uppermost signal contact module 114 mates to the uppermost signal contact pairs of all the signal contact modules 116.

The signal contact modules 114 each include a plurality of receptacle signal contacts 118 (shown in FIG. 3) configured to be terminated directly to the circuit board 106. The header contact modules 116 each include header signal contacts 120 (shown in FIG. 4) configured to be terminated directly to the circuit board 108. The signal contacts 118, 120 may be arranged in pairs within the contact modules 114, 116 with the corresponding mating interfaces aligned in rows (for example, horizontally) or in columns (for example, vertically). In an exemplary embodiment, the signal contact modules 114, 116 are each chicklets comprised of overmolded leadframes; however other types of signal contact modules may be provided in alternative embodiments. Optionally, each contact module 114, 116 may have a shield structure for providing electrical shielding for the signal contacts 118, 120. In alternative embodiments, the contact modules 114, 116 may be un-shielded.

In an exemplary embodiment, the signal contact modules 114, 116 each include dielectric frames 121, 122 that hold the signal contacts 118, 120, respectively. The dielectric frames 121, 122 may be overmolded over the leadframes defining the signal contacts 118, 120. Alternatively, the dielectric frames 121, 122 may be pre-molded and the signal contacts 118, 120 may be inserted into the dielectric frames 121, 122. The dielectric frames 121, 122 are loaded into the housings 110, 112, respectively, to position the signal contacts 118, 120 therein.

The power contact assemblies 117, 119 are electrically connected and transmit power between the circuit boards 106, 108. In an exemplary embodiment, the power contact assemblies 117, 119 include power wires 123, 125, respectively, terminated to ends of power contacts 124, 126 (shown in FIGS. 2 and 4, respectively). The power contacts 124, 126 are electrically connected when the electrical connectors 102, 104 are mated to create the power transmission lines. In an exemplary embodiment, the power wires 123, 125 are terminated to power taps 127, 128 mounted to the circuit boards 106, 108, respectively. Any number of power wires 123, 125 may be provided and a greater number of wires 123, 125 or a lower wire gauge may increase the voltage or current carrying capacity of the power contact assemblies 117, 119. Any type of power taps 127, 128 may be provided, such as stamped and formed, press-fit power taps, board mounted electrical connectors, and the like, which are configured to be terminated directly to the circuit boards 106, 108. Alternatively, the power taps 127, 128, or the power wires 123, 125 themselves, may be soldered directly to the circuit boards 106, 108. The power taps 127, 128 may be located anywhere on the circuit boards 106, 108, such as near the electrical connectors 102, 104 or remote from the electrical connectors 102, 104. For example, by providing longer length power wires 123, 125, the power taps 127, 128 may be positioned further from the electrical connectors 102, 104. As such, the power taps 127, 128 may be placed near other components on the circuit boards that require power, and thus the length of the power traces on the circuit boards 106, 108 may be reduced or eliminated, which may reduce cost and circuit board complexity. The power wires 123, 125 may be routed directly to other components rather than the circuit boards 106, 108.

Other types of power contact assemblies 117, 119 may be provided in alternative embodiments. For example, the power contact assemblies 117 and/or 119 may be power contact modules rather than wire harnesses. For example, the power contact assemblies 117 and/or 119 may be overmolded leadframes, similar to the signal contact assemblies 113, 115, configured to be terminated directly to the circuit boards 106, 108.

Figure 2:
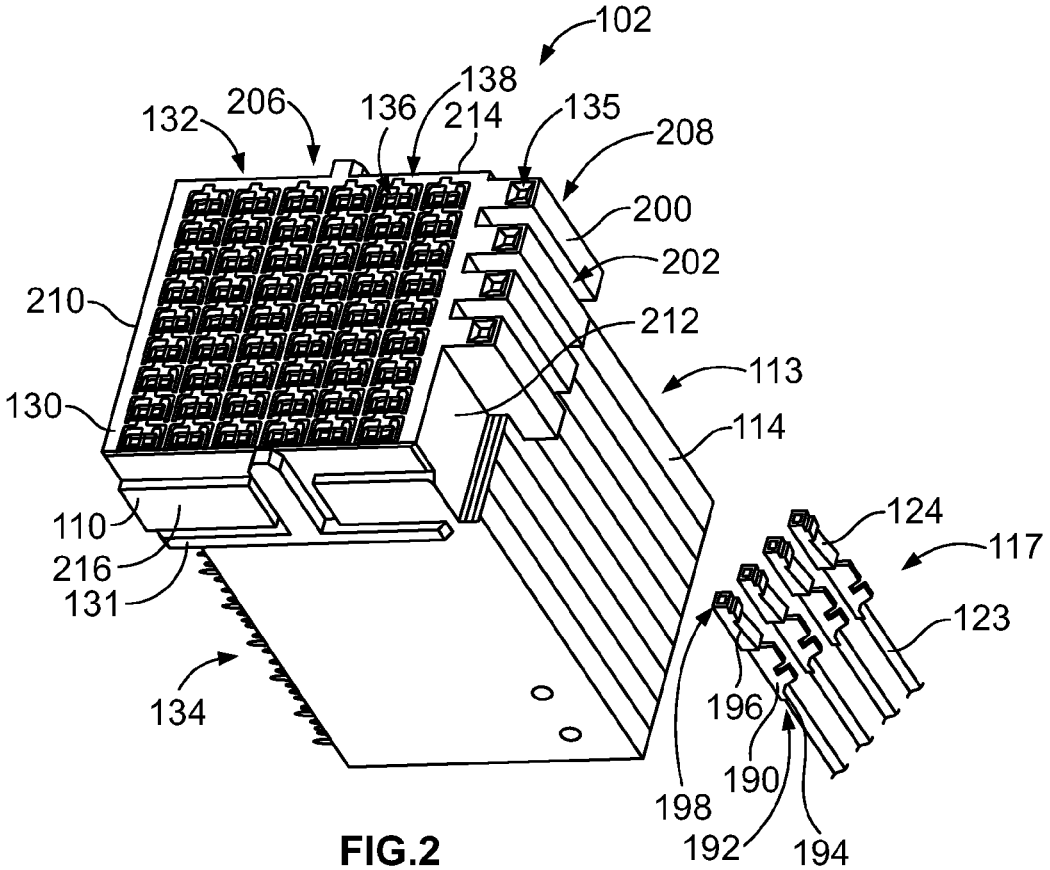
FIG. 2 is a front perspective view of the receptacle connector showing signal contact modules in a stacked arrangement and a power contact assembly in accordance with an exemplary embodiment.
Figure 3:
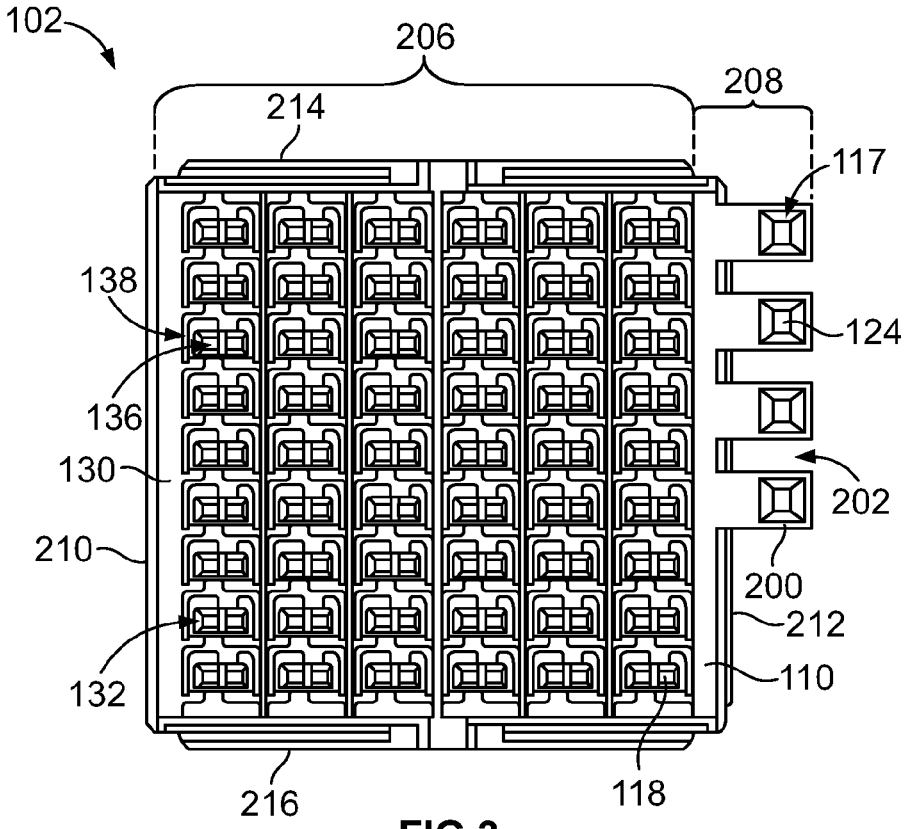
FIG. 3 is a front view of the receptacle connector with the signal contact modules in a stacked arrangement and the power contact assembly.

FIG. 2 is a front perspective view of the receptacle connector 102 showing the power contact assembly 117 poised for loading into the receptacle housing 110. FIG. 3 is a front view of the receptacle connector 102 with the power contact assembly 117 positioned in the housing 110. A front 130 of the housing 110 is illustrated in FIG. 3 showing mating ends of the power contacts 124 and receptacle signal contacts 118. The power contact assembly 117 and the signal contact assembly 113 are exposed or accessible at the front 130 for mating with the header connector 104 (shown in FIG. 1). Optionally, the power contact assembly 117 and the signal contact assembly 113 are loaded into the housing 110 through a rear 131 (FIG. 2) of the housing 110.

The receptacle connector 102 includes a mating end 132 and a mounting end 134. In the illustrated embodiment, the mounting end 134 is substantially perpendicular to the mating end 132 (for example, at a side and at the front 130, respectively, of the receptacle connector 102). However, in other embodiments, other arrangements are possible. For example, the mating end 132 may be substantially parallel to the mounting end 134 (for example, at the front and rear, respectively, of the receptacle connector 102). The receptacle signal contacts 118 (FIG. 2) are received in the housing 110 and extend toward the mating end 132 for mating to the header connector 104. The receptacle signal contacts 118 are arranged in rows and columns at the mating end 132. Any number of receptacle signal contacts 118 may be provided in the rows and columns. In an exemplary embodiment, the pairs of receptacle signal contacts 118 are arranged in the same row at the mating end 132. The receptacle signal contacts 118 also extend to the mounting end 134 for mounting to the circuit board 106. For example, the receptacle signal contacts 118 may be right angle contacts having a right angle bend or multiple bends aggregating to approximately 90°.

The receptacle housing 110 is manufactured from a dielectric material, such as a plastic material. For example, the receptacle housing 110 may be molded into a shape configured to hold and position the power contacts 124 and the signal contacts 118 for mating with the header connector 104. The housing 110 is designed to hold the contact modules 114 in a stacked configuration at the rear 131. The power wires 123 extend from the rear 131 of the housing 110 after the power contacts 124 are loaded into power contact channels 135 of the housing 110. The power contact channels 135 extend through the housing 110 between the front 130 and the rear 131. Optionally, each power contact channel 135 receives a single power contact 124.

The housing 110 includes a plurality of signal contact channels 136 and a plurality of ground contact channels 138 at the mating end 132. The receptacle signal contacts 118 (FIG. 3) are positioned in the housing 110 and aligned with and/or received in corresponding signal contact channels 136. In an exemplary embodiment, the signal contact channels 136 receive corresponding header signal contacts 120 (FIG. 4) therein for mating and electrical coupling with corresponding receptacle signal contacts 118 when the receptacle and header connectors 102, 104 are mated. The ground contact channels 138 receive header shields 139 (FIG. 4) therein for mating and electrical coupling with the shielding structure of the signal contact modules 114 when the receptacle and header connectors 102, 104 are mated.

Figure 4:
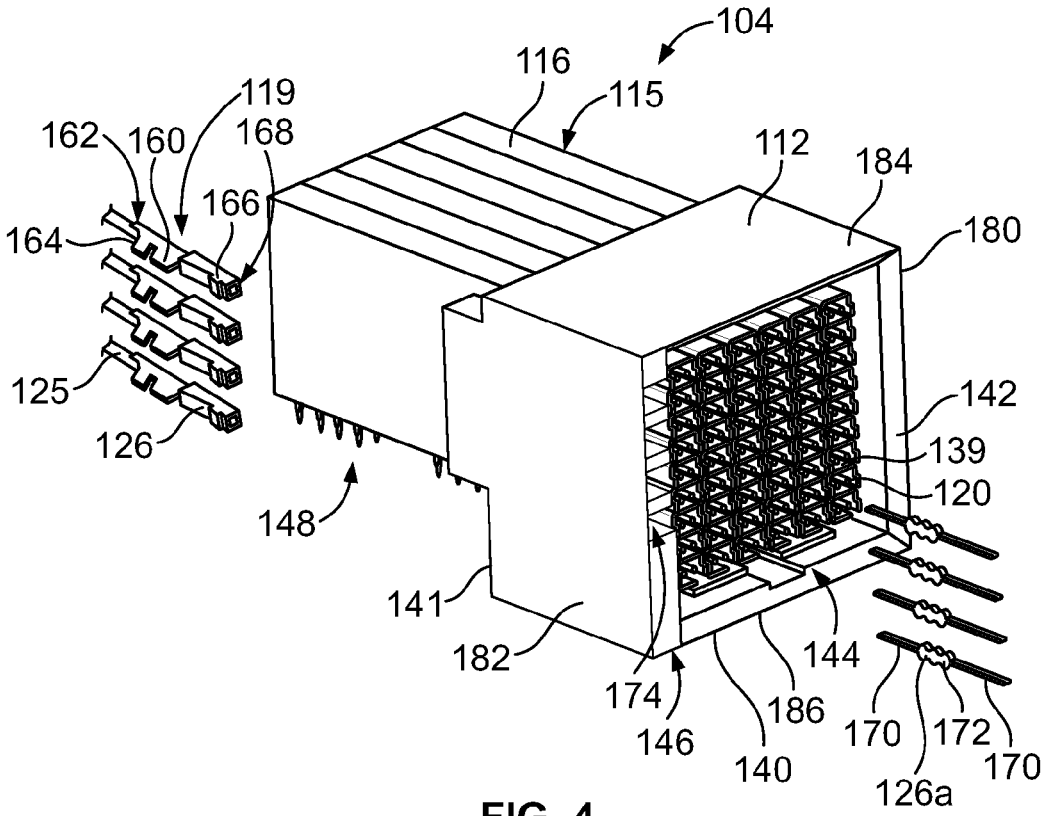
FIG. 4 is a front perspective view of the header connector showing a power contact assembly in accordance with an exemplary embodiment.
Figure 5:
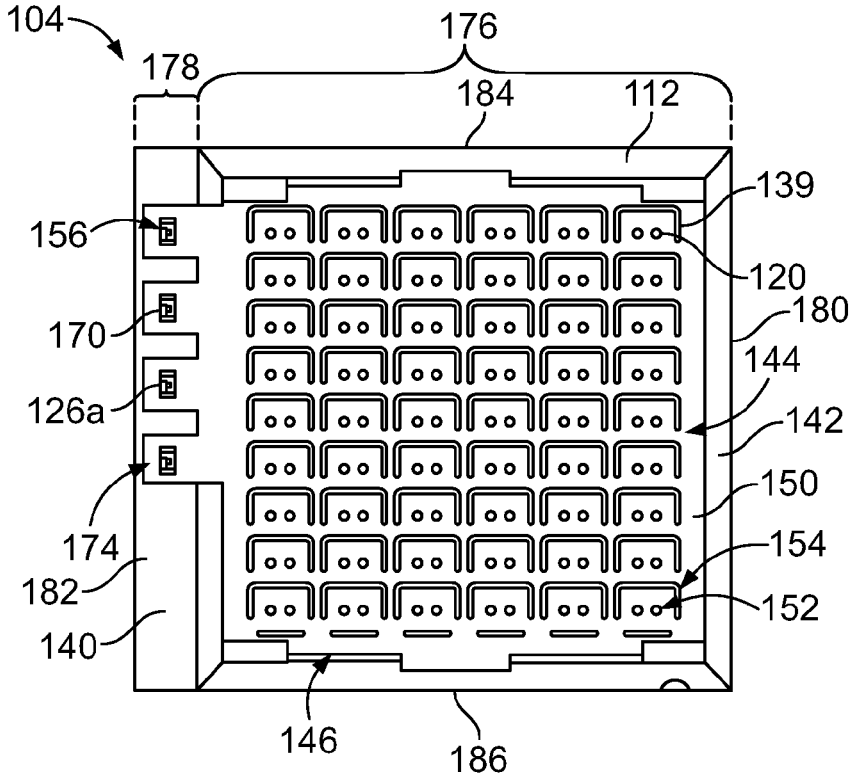
FIG. 5 is a front view of the header connector with the signal contacts in a stacked arrangement and the power contact assembly.

FIG. 4 is a front perspective view of the header connector 104 showing the power contact assembly 119 poised for loading into the header housing 112. FIG. 5 is a front view of the header connector 104 with the power contact assembly 119 positioned in the housing 112. In an exemplary embodiment, the power contact assembly 119 includes the power contacts 126 (FIG. 4) and bus contacts **126*a*. The bus contacts 126*a* are used as an interconnecting contact between the power contacts 126 and the power contacts 124 (FIG. 2) of the receptacle connector 102 (FIG. 2). For example, the bus contacts 126*a* may be double pin contacts with pins at both ends, while the power contacts 124, 126 are socket contacts configured to receive the pins of the bus contacts 126*a*. Other types of contacts may be used in alternative embodiments for the bus contacts 126*a* and the power contacts 124, 126. In other various embodiments, the power contact assembly 119 may not use separate bus contacts 126*a*, but rather the power contacts 126 are configured to directly mate with the power contacts 124 (for example, the power contacts 126 may be pin contacts and the power contacts 124** may be socket contacts, or vice versa).

A front 140 of the housing 112 is illustrated in FIG. 4. The power contact assembly 119 and the signal contact assembly 115 are exposed at the front 140 for mating with the receptacle connector 102. Optionally, the power contact assembly 119 and the signal contact assembly 115 are loaded into the housing 112 through a rear 141 of the housing 112. Mating ends of the bus contacts 126*a*, header signal contacts 120 and header shields 139 may be exposed at the front 140, such as for loading into the receptacle connector 102.

The header housing 112 is manufactured from a dielectric material, such as a plastic material. For example, the header housing 112 may be molded into a shape configured to hold and position the power contacts 126, bus contacts 126*a*, header signal contacts 120 and header shields 139 for mating with the receptacle connector 102. The header housing 112 includes walls 142 defining a chamber 144 configured to receive the mating end of the receptacle connector 102. The mating ends of the bus contacts 126*a*, header signal contacts 120 and header shields 139 are arranged in the chamber 144 for mating with the receptacle connector 102 when the receptacle connector 102 is loaded into the chamber 144. The bus contacts 126*a*, the header signal contacts 120 and the header shields 139 extend entirely through a base 150 into the chamber 144.

The header connector 104 has a mating end 146 and a mounting end 148 that is mounted to the circuit board 108 (FIG. 1). In the illustrated embodiment, the mounting end 148 is substantially perpendicular to the mating end 146 (for example, at the bottom and the front, respectively, of the header connector 104). However, in other embodiments, other arrangements are possible. For example, the mating end 146 may be substantially parallel to the mounting end 148 (for example, at the front and rear, respectively, of the header connector 104). The receptacle connector 102 is received in the chamber 144 through the mating end 146. The housing 110 (FIG. 2) of the receptacle connector 102 engages the walls 142 to hold the receptacle connector 102 in the chamber 144.

In an exemplary embodiment, the header signal contacts 120 are arranged as differential pairs. The header shields 139 are positioned around and between the differential pairs to provide electrical shielding between adjacent differential pairs. The header signal contacts 120 also extend to the mounting end 148 for mounting to the circuit board 108. For example, the header signal contacts 120 may be right angle contacts having a right angle bend or multiple bends aggregating to approximately 90°.

The housing 112 is designed to hold the contact modules 116 in a stacked configuration at the rear 141. The housing 112 includes a plurality of header signal contact channels 152 and a plurality of ground contact channels 154 through the base 150. The header signal contacts 120 extend through the signal contact channels 152 into the chamber 144 for mating and electrical coupling with corresponding receptacle signal contacts 118 when the receptacle and header connectors 102, 104 are mated. The header shields 139 extend through the ground contact channels 154 into the chamber 144 for mating and electrical coupling with the shield structure of the receptacle signal contact modules 114 (FIG. 2) when the receptacle and header connectors 102, 104 are mated.

The power contact assembly 119 is coupled to the housing 112 such that the power contacts 126 and bus contacts 126*a* may be mated with the receptacle connector 102 during the same mating process with the signal contacts 120 and header shields 139. The power wires 125 are terminated to ends of the power contacts 126. For example, the power contacts 126 each include a crimp barrel 160 at a terminating end 162 thereof that is crimp terminated to an end 164 of the corresponding power wire 125. Each power contact 126 includes a socket 166 at a mating end 168 thereof that is configured to receive a pin 170 of the bus contact 126*a*. The power contacts 126 are rear loaded into corresponding power contact channels 156 of the housing 112 and the power wires 125 extend from the rear 141 of the housing 112 after the power contacts 126 are loaded into the power channels 156. The power wires 125 may be routed to any location on the circuit board 108 from the rear 141 of the housing 112.

The power contact channels 156 extend through the base 150 of the housing 112 and are open to the front 140 and the rear 141. Optionally, each power contact channel 156 receives a single power contact 126. The power contacts 126 may be held in the power contact channels 156 using latches or other securing features. Optionally, the power contacts 126 may be held in the power contact channels 156 by an interference fit. In other various embodiments, the power contacts 126 may be held in the power contact channels 156 by the bus contacts 126*a*. For example, the power contacts 126 may be press-fit or friction fit onto the pins 170 of the bus contacts 126*a*.

In an exemplary embodiment, the bus contacts 126*a* are held in corresponding power contact channels 156. For example, the bus contacts 126*a* may be front loaded or rear loaded into the housing 112, such as into the base 150. The bus contacts 126*a* include retention barbs or lances that may dig into the plastic material of the housing 112 to hold the bus contacts 126*a* in the power contact channels 156. For example, each bus contact 126*a* may include a base 172, which may be approximately centrally located between the pins 170 at opposite ends of the bus contact 126*a*, and securing features may extend from the base 172, such as from the top and the bottom of the base 172. Once the bus contacts 126*a* are located in the power contact channels 156, the power contacts 126 may be rear loaded into the power contact channels 156 and mated with the bus contacts 126*a*.

The bus contacts 126*a* extend into the chamber 144 with the header signal contacts 120 and header shields 139 for mating with the receptacle connector 102. For example, the chamber 144 may have pockets 174 along a side of the chamber 144, or elsewhere, which receive corresponding bus contacts 126*a*. The pockets 174 are open to the larger portion of the chamber 144 with the header signal contacts 120 and header shields 139 such that the single receptacle connector 102 (with the power contacts 124) may be received in the chamber 144 for mating both the power and signal lines with a single mating process using a single connector on both the receptacle and header side of the system. In other various embodiments, the chamber 144 may include a single pocket along the side of the chamber 144, or elsewhere, which receives all of the bus contacts 126*a*. Alternatively, the chamber 144 may not include any pockets, but rather the bus contacts 126*a* are in the single large chamber with the signal contacts 120 and header shields 139.

In an exemplary embodiment, the housing 112 has a signal contact section 176 and a power contact section 178 both integrated in the housing 112. For example, the power contact section 178 is integral with the signal contact section 176 as part of a one piece molded body of the housing 112.

Optionally, the signal contact section 176 may be provided at a first side 180 and the power contact section 178 may be provided at a second side 182 of the housing 112. The signal contact section 176 and/or the power contact section 178 extend between a top 184 and a bottom 186 of the housing 112. The signal contact modules 116 are attached to the housing 112 at the signal contact section 176. For example, the signal contact channels 152 extend through the base 150 of the housing 112 at the signal contact section 176. The power contact assembly 119 is attached to the housing 112 at the power contact section 178. For example, the power contact channels 156 extend through the base 150 of the housing 112 at the power contact section 178. Having the signal and power contact sections 176, 178 integrated into the common housing 112 creates an integrated, single mating interface for both power and high speed signals for the direct plug orthogonal connector architecture.

With additional reference back to FIGS. 2 and 3, the power wires 123 are terminated to ends of the power contacts 124. For example, the power contacts 124 each include a crimp barrel 190 at a terminating end 192 thereof that is crimp terminated to an end 194 of the corresponding power wire 123. Each power contact 124 includes a socket 196 at a mating end 198 thereof that is configured to receive the pin 170 (FIG. 4) of the bus contact 126*a* (FIG. 4). The power contacts 124 are rear loaded into corresponding power contact channels 135 of the housing 110 and the power wires 123 extend from the rear 131 of the housing 110 after the power contacts 124 are loaded into the power channels 135. The power wires 123 may be routed to any location on the circuit board 106 (FIG. 1) from the rear 131 of the housing 110.

The power contact channels 135 extend through the housing 110 between the front 130 and the rear 131. In an exemplary embodiment, the power contact channels 135 are formed in ears 200 extending from the side of the housing 110. The ears 200 are integral with the housing 110. The ears 200 are separated by gaps 202 and each ear 200 is configured to be received in a corresponding one of the pockets 174 (FIG. 4). Optionally, each power contact channel 135 receives a single power contact 124. The power contacts 124 may be held in the power contact channels 135 using latches or other securing features. Optionally, the power contacts 124 may be held in the power contact channels 135 by an interference fit.

In an exemplary embodiment, the housing 110 has a signal contact section 206 and a power contact section 208 both integrated in the housing 110. For example, the power contact section 208 is integral with the signal contact section 206 as part of a one piece molded body of the housing 110. Optionally, the signal contact section 206 may be provided at a first side 210 and the power contact section 208 may be provided at a second side 212 of the housing 110. The signal contact section 206 and/or the power contact section 208 extend between a top 214 and a bottom 216 of the housing 110. The signal contact modules 114 are attached to the housing 110 at the signal contact section 206. For example, the signal contact channels 136 extend through the housing 110 at the signal contact section 206. The power contact assembly 117 is attached to the housing 110 at the power contact section 208. For example, the power contact channels 135 extend through the housing 110 at the power contact section 208. Having the signal and power contact sections 206, 208 integrated into the common housing 110 creates an integrated, single mating interface for both power and high speed signals for the direct plug orthogonal connector architecture.

Figure 6:
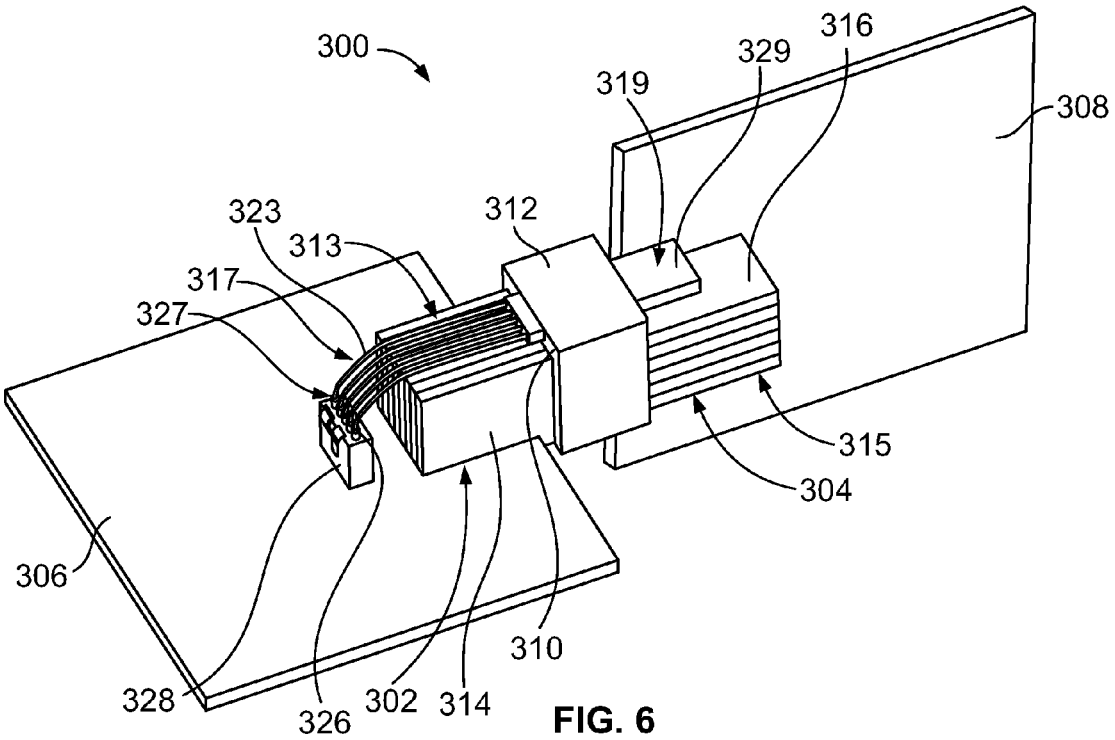
FIG. 6 is a perspective view of an exemplary embodiment of an electrical connector system formed in accordance with an exemplary embodiment showing receptacle and header connectors directly mated together in an orthogonal orientation.

FIG. 6 is a perspective view of an exemplary embodiment of an electrical connector system 300 formed in accordance with an exemplary embodiment. The electrical connector system 300 is similar to the electrical connector system 100 (FIG. 1) and not all like components will be described in detail. The electrical connector system 300 includes electrical connectors 302 and 304 (may be referred to hereinafter as receptacle and header connectors 302, 304, respectively) similar to the electrical connectors 102, 104 (FIG. 1), which may be directly mated together. The receptacle and header connectors 302, 304 are each electrically connected to respective circuit boards 306, 308 having an orthogonal orientation. In an exemplary embodiment, the receptacle and header connectors 302, 304 convey power, in addition to signals. The receptacle connector 302 having a wire harness power contact assembly while the header connector 304 has a different type of power contact assembly, such as a chicklet or contact module power contact assembly.

The receptacle and header connectors 302, 304 include receptacle and header housings 310 and 312, respectively. The housings 310, 312 each hold a signal contact assembly 313, 315, respectively, and a power contact assembly 317, 319, respectively. The electrical connectors 302, 304 thus transmit both data signals and power through a single, integrated mating interface for the direct plug orthogonal connector architecture. Similar to the electrical connectors 102, 104, the receptacle and header signal contact assemblies 313, 315 include a plurality of receptacle and header signal contact modules 314, 316, respectively, having corresponding signal contacts (not labeled).

The power contact assembly 317 is a wire harness type of power assembly similar to the power contact assembly 117 (FIG. 1). However, the power contact assembly 319 is a contact module type of power assembly. The power contact assembly 317 includes power wires 323 terminated to power contacts 324 (shown in FIG. 7) received in the housing 310 and power contacts 326 received in a power connector 327 that may be electrically connected to the circuit board 306, such as by mating to a circuit board power connector 328. The power wires 323 extend along the top of the receptacle connector 302 rather than along the side of the connector, as with the receptacle connector 102. Other arrangements are possible in alternative embodiments.

The power contact assembly 319 includes a power contact module 329 that is coupled to the rear of the housing 312. In an exemplary embodiment, the power contact module 329 is an overmolded leadframe module; however other types of modules may be used in alternative embodiments.

Figure 7:
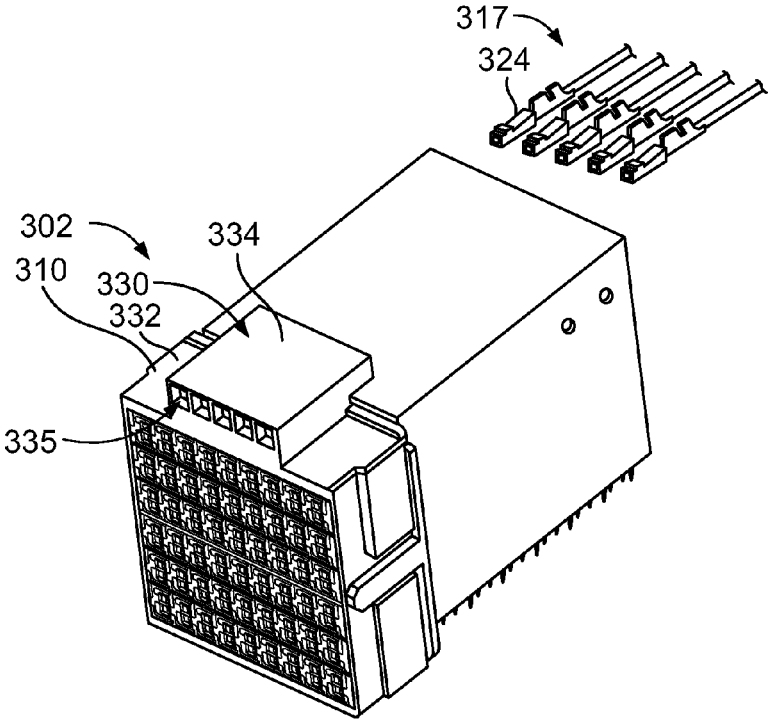
FIG. 7 is a front perspective view of a receptacle connector shown in FIG. 6.

FIG. 7 is a front perspective view of the receptacle connector 302 showing the power contact assembly 317 poised for loading into the receptacle housing 310. The receptacle connector 302 is similar to the receptacle connector 102 (FIG. 1). The receptacle connector 302 includes a power contact section 330 at a top 332 of the housing 310. Other arrangements and positions of the power contact section are possible in alternative embodiments. The power contact section 330 includes a single ear 334 at the top 332. The ear 334 includes a plurality of power contact channels 335 that receive the power contacts 324.

Figure 8:
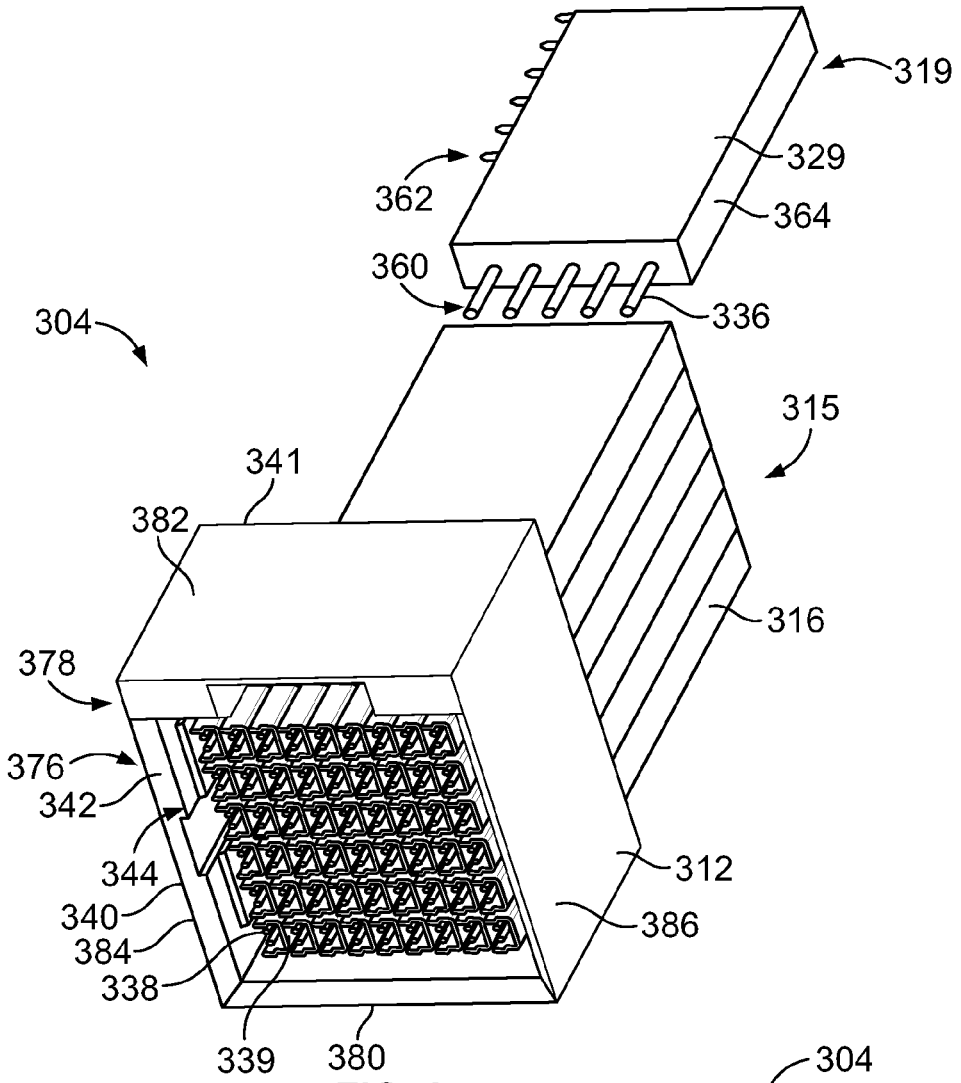
FIG. 8 is a front perspective view of a header connector shown in FIG. 6.
Figure 9:
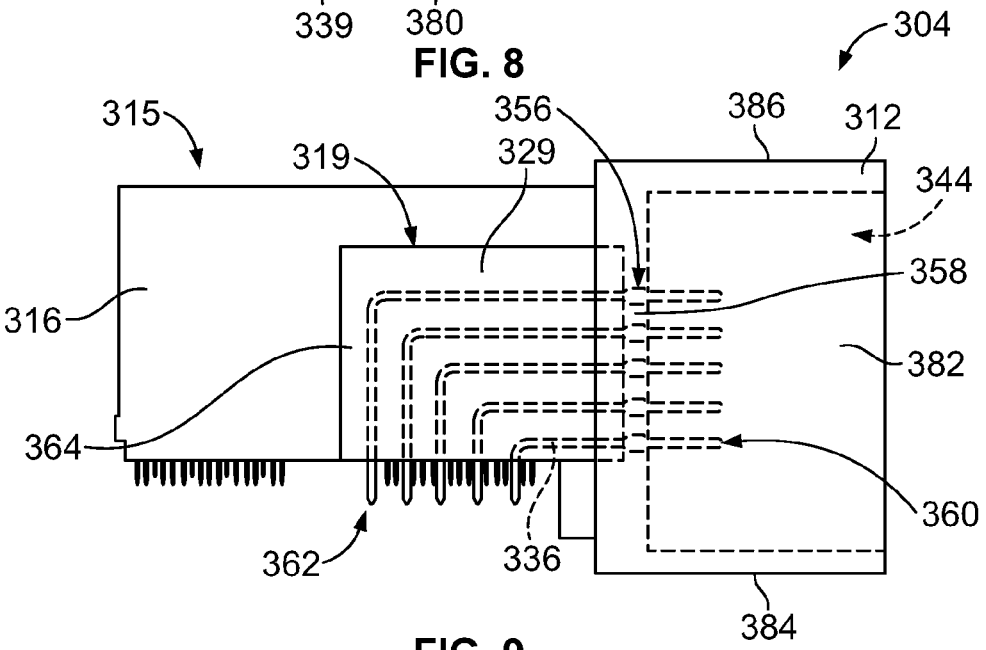
FIG. 9 is a side view of the header connector shown in FIG. 8.

FIG. 8 is a front perspective view of the header connector 304 showing the power contact assembly 319 poised for loading into the header housing 312. FIG. 9 is a top view of the header connector 304 with the power contact assembly 319 positioned in the housing 312 showing header power contacts 336 of the power contact module 329 in phantom.

A front 340 of the housing 312 is illustrated in FIG. 8 showing mating ends of header signal contacts 338 and header shields 339. The power contact assembly 319 and the signal contact assembly 315 are configured to be exposed at the front 340 for mating with the receptacle connector 302. Optionally, the power contact assembly 319 and the signal contact assembly 315 are loaded into the housing 312 through a rear 341 of the housing 312. The header housing 312 includes walls 342 defining a chamber 344. Mating ends of the header power contacts 336, header signal contacts 338 and header shields 339 are arranged in the chamber 344 for mating with the receptacle connector 302 when the receptacle connector 302 is loaded into the chamber 344.

Power contact channels 356 (shown in phantom in FIG. 9) extend through a base 358 of the housing 312 and are open to the front 340 and the rear 341. Each power contact channel 356 receives a single power contact 336. The power contacts 336 may be held in the power contact channels 356 using a friction fit, latches or other securing features.

The housing 312 is designed to hold the signal contact modules 316 in a stacked configuration at the rear 341. The power contact module 329 is coupled to the housing 312 at the rear 341 and may be stacked adjacent the signal contact modules 316 such that the power contacts 336 may be mated with the receptacle connector 302 during a single mating process along with the header signal contacts 338 and header shields 339. In an exemplary embodiment, mating ends 360 of the power contacts 336 extend forward from an edge of the power contact module 329 for loading into the chamber 344. Terminating ends 362 of the power contacts 336 extend from another edge of the power contact module 329 for termination to the circuit board 308 (FIG. 6). The power contacts 336 may be right angle power contacts. Optionally, the power contacts 336 are part of a stamped and formed leadframe that is overmolded with dielectric material to form a dielectric frame 364. The dielectric frame 364 supports and positions the power contacts 336. Optionally, at least a portion of the dielectric frame 364 may be loaded into the rear of the housing 312 and held in the housing 312, such as by an interference fit, by latches or by other securing features.

In an exemplary embodiment, the housing 312 has a signal contact section 376 and a power contact section 378 both integrated in the housing 312. For example, the signal contact section 376 is provided at a bottom 380 and the power contact section 378 is provided at a top 382 of the housing 312. The signal contact section 376 and/or the power contact section 378 extend between sides 384, 386 of the housing 312. The signal contact modules 316 are attached to the housing 312 at the signal contact section 376. For example, signal contact channels (not shown) extend through the base 358 of the housing 312 at the signal contact section 376. The power contact assembly 319 is attached to the housing 312 at the power contact section 378. For example, the power contact channels 356 extend through the base 358 of the housing 312 at the power contact section 378. Having the signal and power contact sections 376, 378 integrated into the common housing 312 creates an integrated, single mating interface for both power and high speed signals for the direct plug orthogonal connector architecture.

Figure 10:
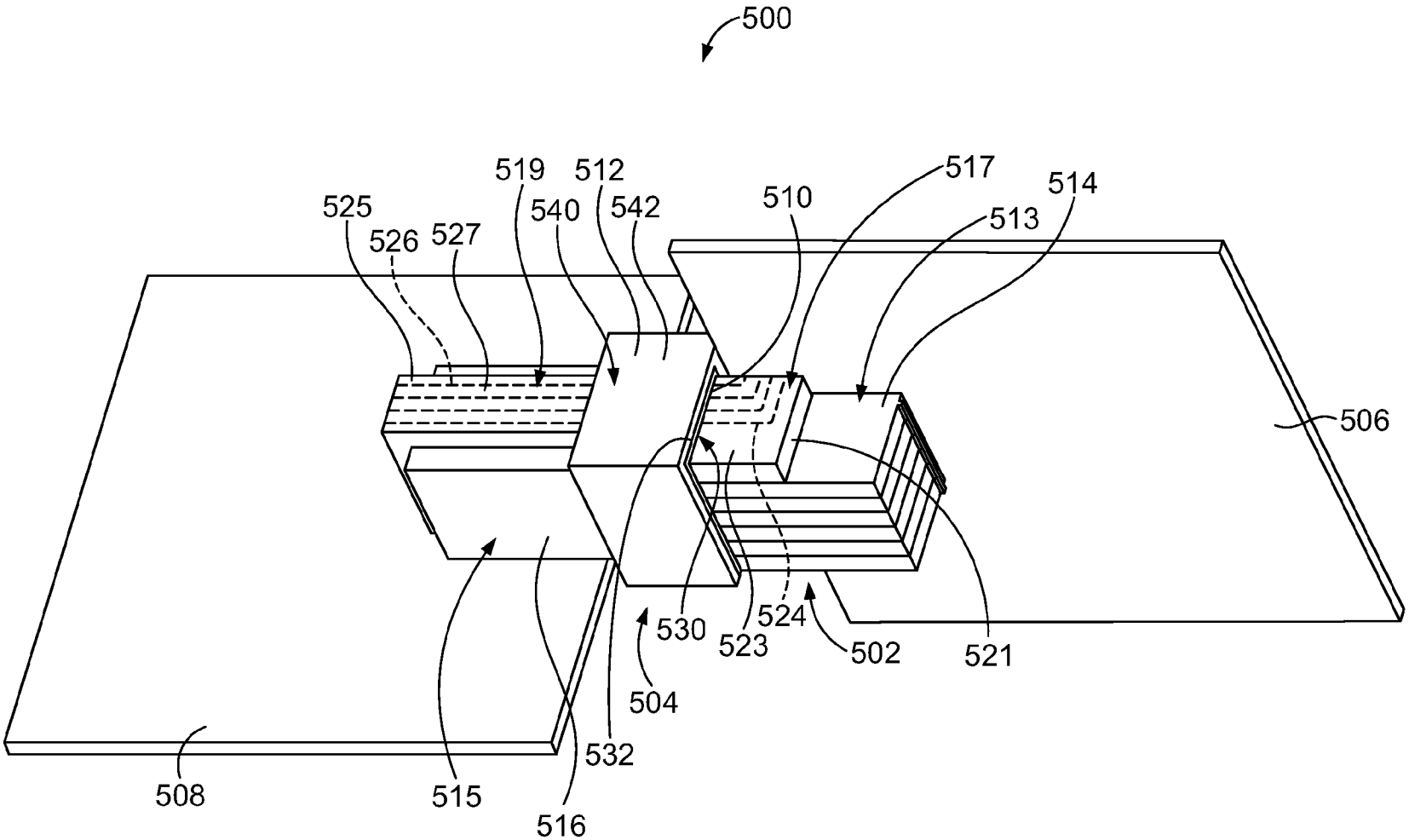
FIG. 10 is a perspective view of an exemplary embodiment of an electrical connector system formed in accordance with an exemplary embodiment showing receptacle and header connectors directly mated together in an orthogonal orientation.

FIG. 10 is a perspective view of an exemplary embodiment of an electrical connector system 500 formed in accordance with an exemplary embodiment. The electrical connector system 500 is similar to the electrical connector system 100 (FIG. 1) and/or the electrical connector system 300 (FIG. 6), and not all like components will be described in detail. The electrical connector system 500 includes electrical connectors 502 and 504 (may be referred to hereinafter as receptacle and header connectors 502, 504, respectively) similar to the electrical connectors 102, 104 (FIG. 1) and/or the electrical connectors 302, 304 (FIG. 6), which may be directly mated together. The receptacle and header connectors 502, 504 are electrically connected to respective circuit boards 506, 508 having an orthogonal orientation. In an exemplary embodiment, the receptacle and header connectors 502, 504 convey power, in addition to signals, via chicklet or contact module type power contact assemblies, which may be similar to the power contact assembly 319 (FIG. 6) as opposed to the wire harness type of power contact assemblies 117, 119, 317 (shown in FIGS. 1 and 5).

The receptacle and header connectors 502, 504 include receptacle and header housings 510 and 512, respectively. The housings 510, 512 each hold a signal contact assembly 513, 515, respectively, and a power contact assembly 517, 519, respectively. The electrical connectors 502, 504 both transmit data signals and power through a single, integrated mating interface for the direct plug orthogonal connector architecture. Similar to the electrical connectors 102, 104, the receptacle and header signal contact assemblies 513, 515 include a plurality of receptacle and header signal contact modules 514, 516, respectively, having corresponding signal contacts (not labeled).

The power contact assembly 517 includes a power contact module 521 having a dielectric frame 523 holding a plurality of power contacts 524 (shown in phantom). The power contact module 521 is coupled to the rear of the housing 510. In an exemplary embodiment, the power contact module 521 is an overmolded leadframe module; however other types of modules may be used in alternative embodiments. The power contact assembly 519 includes a power contact module 525 having a plurality of power contacts 526 (shown in phantom) held by a dielectric frame 527. The power contact module 525 is coupled to the rear of the housing 512. In an exemplary embodiment, the power contact module 525 is an overmolded leadframe module; however other types of modules may be used in alternative embodiments.

The receptacle connector 502 is similar to the receptacle connector 102 (FIG. 1); however the receptacle connector 502 includes a power contact section 530 at a top 532 of the housing 510, rather than along the side. The power contact module 521 is stacked above or along the top side of the stack of signal contact modules 514. The power contact module 521 is configured to be rear loaded into a channel in the housing 510.

The header connector 504 is similar to the header connector 304 (FIG. 6) including a power contact section 540 at a top 542 of the housing 512. The power contact module 525 extends along the tops of the signal contact modules 516 and along the backs of the signal contact modules 516 to terminate to the circuit board 508. The power contact module 525 is configured to be rear loaded into a channel in the housing 512.

Embodiments described herein provide a direct plug orthogonal connector having integrated power and signal interfaces for connectivity of both power and high-speed signals for a direct plug orthogonal architecture. The power contact assembly integrates into the high-speed electrical connector (for example, backplane connector). The integrated connectors provide a low profile design for direct plug orthogonal space restrictions. The connectors provide a single mating action for the operator. The connectors eliminate the need for independent power and high-speed signal connectors and two step mating operations. Embodiments provide board mounted designs and cable power options.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

What is claimed is:

1. An electrical connector comprising:

a housing having a front configured to mate with a mating electrical connector and a rear opposite the front, the housing having a signal contact section and a power contact section, the housing having a plurality of signal contact channels extending therethrough at the signal contact section, the housing having a plurality of power contact channels extending therethrough at the power contact section;

a signal contact assembly coupled to the rear of the housing, the signal contact assembly having a plurality of signal contacts aligned with corresponding signal contact channels and configured for mating with the mating electrical connector, the signal contacts being configured to be terminated to a circuit board; and a power contact assembly coupled to the rear of the housing, the power contact assembly having a plurality of power contacts received in corresponding power contact channels and configured for electrical connection with the mating electrical connector, the power contacts being terminated to ends of power wires, the power wires being configured to be electrically connected to the circuit board remote from the signal contacts.

2. The electrical connector of claim 1, wherein the power contact channels are open at the rear to allow the power wires to extend from the rear of the housing.

3. The electrical connector of claim 1, wherein the power wires are terminated to at least one power tap configured to be mounted to the circuit board.

4. The electrical connector of claim 1, wherein the housing comprises a chamber defined by both the signal contact section and the power contact section, the power contacts and the signal contacts being exposed in the chamber for mating with the mating electrical connector.

5. The electrical connector of claim 1, wherein the housing comprises a base and a plurality of walls defining a chamber, the signal contact channels and the power contact channels passing through the base to open to the chamber.

6. The electrical connector of claim 1, wherein the housing comprises a top, a bottom, and opposite first and second sides, the power contact section extending along the first side between the top and the bottom, the signal contact section extending along the second side between the top and the bottom.

7. The electrical connector of claim 1, wherein the power contacts directly engage the housing within the power contact channels to hold the power contacts in the power contact channels.

8. The electrical connector of claim 1, wherein each power contact comprises a socket at a mating end and a crimp barrel at a terminating end crimp terminated to the end of the corresponding power wire.

9. The electrical connector of claim 1, further comprising bus contacts held in the power contact channels, the power contacts being coupled to first ends of corresponding bus contacts, second ends of the bus contacts being mated to the mating electrical connector when the housing is mated with the mating electrical connector.

10. The electrical connector of claim 1, wherein the power contact section is integral with the signal contact section as part of a one piece molded body of the housing.

11. The electrical connector of claim 1, wherein the housing includes ears extending from the side of the housing, each ear having a corresponding power contact channel and receiving a corresponding power contact.

12. An electrical connector comprising:

a housing having a front end configured to mate with a mating electrical connector and a rear end opposite the front end, the housing having a signal contact section and a power contact section, the housing having a plurality of signal contact channels extending therethrough at the signal contact section, the housing having a plurality of power contact channels extending therethrough at the power contact section;

a signal contact assembly coupled to the rear end of the housing, the signal contact assembly having a plurality of signal contact modules in a stacked arrangement, each signal contact module having a dielectric frame holding a plurality of signal contacts, the dielectric frame is coupled to the rear end of the housing such that the signal contacts are aligned with corresponding signal contact channels and configured for mating with the mating electrical connector, the signal contacts extend from the dielectric frame and are configured to be terminated to a circuit board; and a power contact assembly having a power contact module coupled to the rear end of the housing, the power contact module having a dielectric frame holding a plurality of power contacts, the dielectric frame is coupled to the rear end of the housing such that the power contacts extend into the housing and are received in corresponding power contact channels for electrical connection with the mating electrical connector, the power contacts being terminated to ends of power wires, the power wires extending rearward from the power contact module and the housing for electrical connection to the circuit board remote from the signal contacts.

13. The electrical connector of claim 12, wherein the signal contact modules and the power contact module are plugged into the rear end of the housing and held therein.

14. The electrical connector of claim 12, wherein the dielectric frame of the power contact module is overmolded over the power contacts with mating ends extending from the dielectric frame and mounting ends extending from the dielectric frame, the mating ends being received in corresponding power contact channels, the mounting ends being terminated to the circuit board.

15. The electrical connector of claim 12, wherein the power contacts are right angle power contacts having a right angle bend between a mating end and a mounting end thereof.

16. An electrical connector system comprising:

a receptacle connector terminated to a first circuit board and a header connector terminated to a second circuit board, the receptacle and header connectors being directly plugged together with the first and second circuit boards being orthogonal to each other;

the receptacle connector comprising a receptacle housing having a signal contact section and a power contact section with signal contact channels and power contact channels extending therethrough at the signal and power contact sections, respectively, a receptacle signal contact assembly being coupled to a rear end of the receptacle housing with receptacle signal contacts aligned with corresponding signal contact channels and a receptacle power contact assembly being coupled to the rear end of the receptacle housing with receptacle power contacts received in corresponding power contact channels; and the header connector comprising a header housing having a signal contact section and a power contact section with signal contact channels and power contact channels extending therethrough at the signal and power contact sections, respectively, a header signal contact assembly being coupled to a rear end of the header housing with header signal contacts aligned with corresponding signal contact channels and a header power contact assembly being coupled to the rear end of the header housing with header power contacts received in corresponding power contact channels, the header signal contacts being mated with corresponding receptacle signal contacts and the header power contacts being mated with corresponding receptacle power contacts;

wherein at least one of the receptacle power contact assembly and the header power contact assembly includes a plurality of power wires terminated to ends of the corresponding receptacle power contacts or header power contacts, the power wires being configured to be electrically connected to the corresponding circuit board remote from the corresponding receptacle housing or header housing.

17. The electrical connector system of claim 16, wherein the receptacle power contact assembly includes a power contact module having a dielectric frame holding the receptacle power contacts, the dielectric frame being coupled to the receptacle housing.

18. The electrical connector system of claim 16, wherein the header power contact assembly includes a power contact module having a dielectric frame holding the header power contacts, the dielectric frame being coupled to the header housing.

* * * * *